US009506148B2

(12) United States Patent
Chen et al.

(10) Patent No.: US 9,506,148 B2
(45) Date of Patent: Nov. 29, 2016

(54) METHOD FOR FORMING FLEXIBLE TRANSPARENT CONDUCTIVE FILM

(71) Applicant: NATIONAL CHENG KUNG UNIVERSITY, Tainan (TW)

(72) Inventors: In-Gann Chen, Tainan (TW); Chang-Shu Kuo, Tainan (TW); Hung-Tao Chen, Kaohsiung (TW); Pei-Ying Hsieh, Taichung (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 0 days.

(21) Appl. No.: 14/451,573

(22) Filed: Aug. 5, 2014

(65) Prior Publication Data

US 2015/0104565 A1 Apr. 16, 2015

(30) Foreign Application Priority Data

Oct. 15, 2013 (TW) ..... 102137128 A

(51) Int. Cl.

| | |
|---|---|
| ***B05D 3/06*** | (2006.01) |
| ***B05D 3/10*** | (2006.01) |
| ***C23C 18/16*** | (2006.01) |
| ***D01D 5/00*** | (2006.01) |
| ***C23C 18/31*** | (2006.01) |
| ***D06M 11/83*** | (2006.01) |
| ***D01F 1/10*** | (2006.01) |
| ***C23C 18/20*** | (2006.01) |
| ***C23C 18/30*** | (2006.01) |
| ***C23C 18/44*** | (2006.01) |

(52) U.S. Cl.

CPC ..... *C23C 18/1633* (2013.01); *C23C 18/1641* (2013.01); *C23C 18/2033* (2013.01); *C23C 18/30* (2013.01); *C23C 18/31* (2013.01); *C23C 18/44* (2013.01); *D01D 5/003* (2013.01); *D01F 1/10* (2013.01); *D06M 11/83* (2013.01)

(58) Field of Classification Search

USPC ..... 427/304, 305, 306, 443.1

See application file for complete search history.

(56) References Cited

U.S. PATENT DOCUMENTS

| | | | | |
|---|---|---|---|---|
| 3,925,578 | A * | 12/1975 | Polichette | C23C 18/26 427/304 |
| 5,385,760 | A * | 1/1995 | Schassberger | B24D 3/14 205/109 |
| 6,376,023 | B1 * | 4/2002 | Mori | C01G 23/0536 427/430.1 |
| 2007/0218281 | A1 * | 9/2007 | Demir | B82Y 30/00 428/389 |
| 2013/0230657 | A1 * | 9/2013 | Milum | C23C 18/31 427/443.1 |

OTHER PUBLICATIONS

Bin Guo, Continuous thin gold films electroless deposited on fibrous mats of polyacrylonitrile and their electrocatalytic activity towards the oxidation of methanol, Feb. 2008, Electrochimica Acta, 53, p. 5174-5179.*

* cited by examiner

*Primary Examiner* — Dah-Wei D Yuan
*Assistant Examiner* — Nga Leung V Law
(74) *Attorney, Agent, or Firm* — Nixon & Vanderhye P.C.

(57) ABSTRACT

A method for forming a flexible transparent conductive film includes steps of: (a) electrospinning a first solution, which contains a polymer, a solvent and a metal ion-containing precursor, to form an polymeric fiber onto a soluble substrate; (b) providing energy to reduce the metal ion-containing precursor of the polymeric fiber, so as to form metal seeds on the polymeric fiber; and (c) placing the polymeric fiber together with the soluble substrate into a second solution, such that the soluble substrate dissolves in the second solution to form an electroless-plating bath and such that the polymeric fiber is subjected to electroless plating to form a metal coating from the metal seeds.

18 Claims, 15 Drawing Sheets

METHOD FOR FORMING FLEXIBLE TRANSPARENT CONDUCTIVE FILM

CROSS-REFERENCE TO RELATED APPLICATION

This application claims priority of Taiwanese Patent Application No. 102137128, filed on Oct. 15, 2013.

BACKGROUND OF THE INVENTION

1. Field of the Invention

The invention relates to a method for forming a transparent conductive film, more particularly to a method for forming a flexible transparent conductive film.

2. Description of the Related Art

Indium tin oxide (ITO) transparent conductive films have been widely adopted in flat panel displays or optoelectronic devices due to their intrinsic properties of high conductivity and good light transmittance. However, skilled artisans in the related field are still making lots of efforts to seek replacements for the ITO films because of their relatively high costs and poor mechanical properties.

Hui Wu et al. disclosed a method for making a conventional flexible transparent conductive film, which includes the following steps of: electrospinning polyvinyl acetate which contains copper acetate, so as to form on a glass substrate a plurality of electrospun polymeric fibers which constitute a web structure, which contain Cu precursors, and which have a diameter of 200 nm and a length of 1 cm; heating the web structure at 500° C. in air for 2 hours to transform the Cu precursor-containing web structure into a CuO nano-web structure (dark-brown color) and to remove the electrospun polymeric fibers; and annealing the CuO nano-web structure for 1 hour, thereby reducing CuO of the CuO nano-web structure into Cu so as to obtain the conventional flexible transparent conductive film of Cu nano-web structure (see "*Electrospun Metal Nanofiber Webs As High-Performance Transparent Electrodes,*" *Nano Lett.* 2010, 10, 4242-4248, abbreviated as Prior art 1).

Although the conventional flexible transparent conductive film made by the method of Prior art 1 can have a light transmittance of 90% and a sheet resistance of 50Ω/□, the step of annealing at high temperature (300° C.) is needed to reduce the CuO. Moreover, due to the intrinsic chemical activity of copper, when thermal oxidation or chemical corrosion occurs, the sheet resistance of the conventional flexible transparent conductive film may increase, resulting in relatively low durability and reliability.

Hui Wu et al. further disclosed a method for forming another conventional flexible transparent conductive film, which includes the following steps of: electrospinning a polymer-containing solution to form on a copper frame a polymeric network template, wherein the polymer-containing solution is, e.g., 10 wt % of a polyvinyl alcohol (PVA) aqueous solution or 14 wt % of a polyvinyl pyrrolidone (PVP) aqueous solution; depositing a conductive layer on one side of the polymeric network template via thermal evaporation under a base pressure of $10^{-6}$ Torr when Cr, Au, Cu, Ag, or Al is selected, via e-beam evaporation under a base pressure of $10^{-6}$ Torr when Pt or Ni is selected, or via magnetron sputtering under a working pressure of 5 mTorr when silicon or Indium tin oxide is selected; and transferring the polymeric network template onto a solid substrate, followed by dissolving the polymeric network template to form the conventional flexible transparent conductive film (see "*A transparent electrode based on a metal nanotrough network*", *Nature Nanotechnology*, volume 8, June, 2013, 421-425, abbreviated as Prior art 2).

Although the conventional flexible transparent conductive film made by the method of Prior art 2 exhibits relatively high fatigue resistivity in comparison to ITO transparent conductive films, the step of depositing the conductive layer under vacuum is still needed and thereby significantly increases the production cost.

SUMMARY OF THE INVENTION

Therefore, the object of the present invention is to provide a method for forming a flexible transparent conductive film that may alleviate the aforementioned drawbacks of the prior art.

Accordingly, a method for forming a flexible transparent conductive film of the present invention includes the following steps of:

(a) electrospinning a first solution, which contains a polymer, a solvent and a metal ion-containing precursor, to form an electrospun polymeric fiber onto a soluble substrate;

(b) providing energy to reduce the metal ion-containing precursor of the electrospun polymeric fiber, so as to form metal seeds on the electrospun polymeric fiber; and (c) placing the electrospun polymeric fiber together with the soluble substrate into a second solution, such that the soluble substrate dissolves in the second solution to form an electroless-plating bath and such that the electrospun polymeric fiber is subjected to electroless plating to form a metal coating from the metal seeds.

BRIEF DESCRIPTION OF THE DRAWINGS

Other features and advantages of the present invention will become apparent in the following detailed description of the preferred embodiment with reference to the accompanying drawings, of which:

FIG. 13(*b*) is a schematic diagram illustrating that the flexible transparent conductive film of Example 5 is subjected to fatigue resistance analysis;

DETAILED DESCRIPTION OF THE PREFERRED EMBODIMENT

Figure 1A:
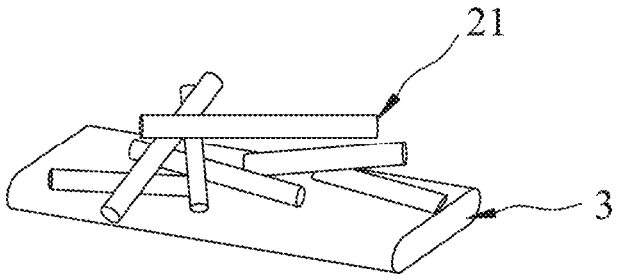
FIGS. 1(*a*) to 1(*c*) are schematic diagrams of a preferred embodiment according to the present invention, illustrating steps (a) to (c) of a method for forming a flexible transparent conductive film according to the present invention.
Figure 1B:
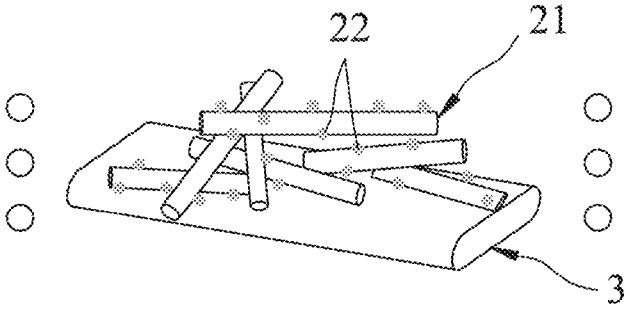
Figure 1C:
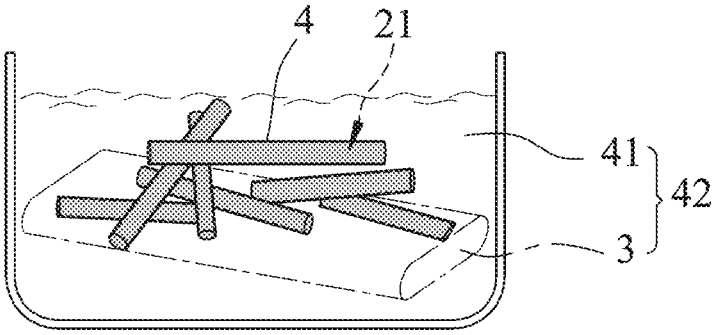

Referring to FIGS. 1(*a*) to 1(*c*), the preferred embodiment of a method for forming a flexible transparent conductive film according to the present invention is shown to include the following steps of:

(a) electrospinning a first solution, which contains a polymer, a solvent and a metal ion-containing precursor, to form an electrospun polymeric fiber 21 onto a soluble substrate 3;

(b) providing energy to reduce the metal ion-containing precursor of the electrospun polymeric fiber 21, so as to form nano-scale metal seeds 22 on the electrospun polymeric fiber 21; and (c) placing the electrospun polymeric fiber 21 together with the soluble substrate 3 into a second solution 41, such that the soluble substrate 3 dissolves in the second solution 41 to form an electroless-plating bath 42 and such that the electrospun polymeric fiber 21 is subjected to electroless plating to form a metal coating 4 from the nano-scale metal seeds 22.

Figure 2:
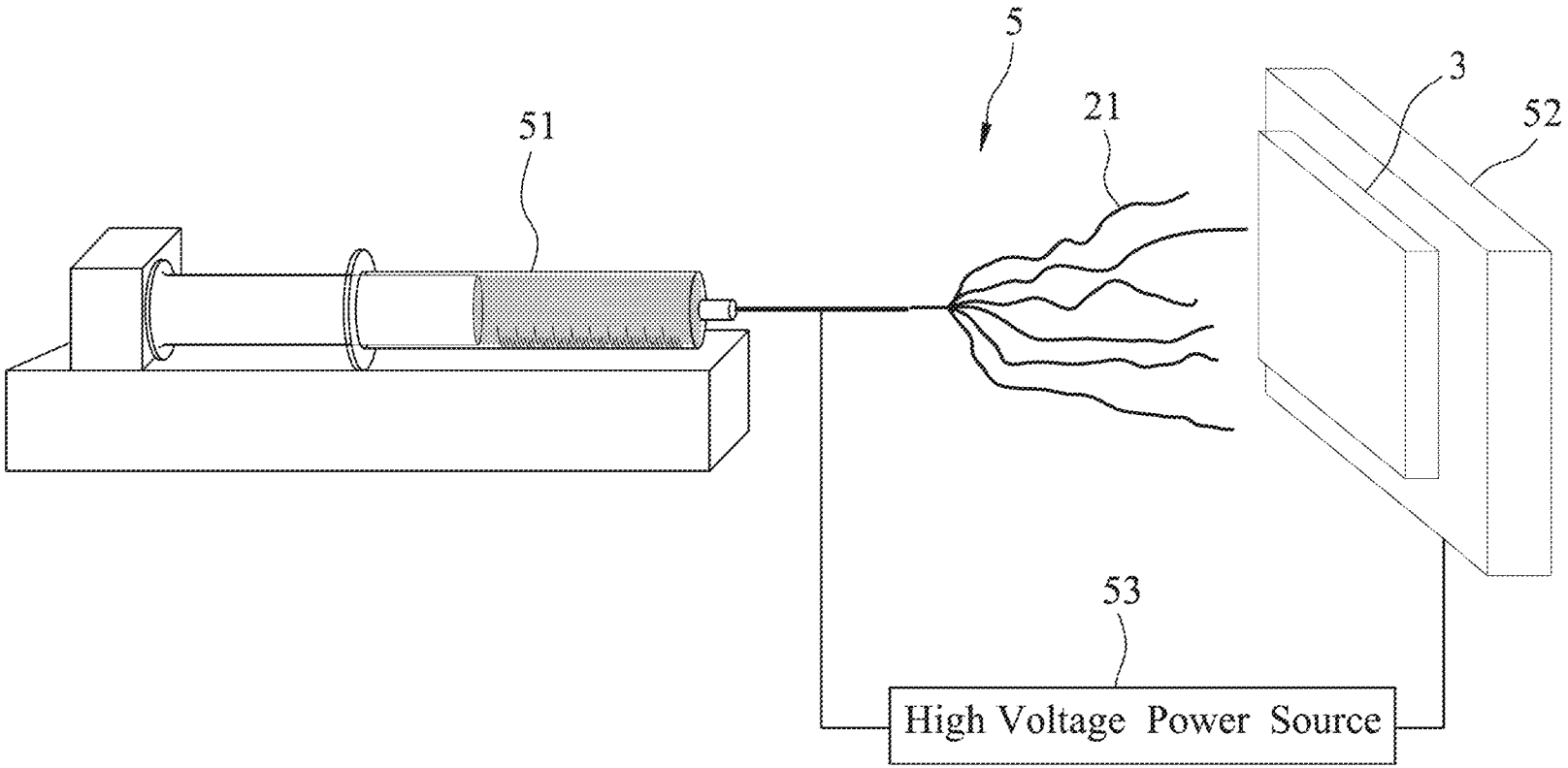
FIG. 2 is a schematic diagram of an electrospinning apparatus used in step (a) of the preferred embodiment.

In this embodiment, step (a) is conducted utilizing an electrospinning apparatus 5 as shown in FIG. 2. The electrospinning apparatus 5 includes a spinneret 51, a collector 52 spaced apart from the spinneret 51, and a high-voltage power source 53. In this embodiment, the spinneret 51 is a hypodermic syringe needle loaded with the first solution. A syringe pump is associated with the hypodermic syringe needle and is operable to control a flow rate of the first solution through the spinneret 51. The high-voltage power source 53 is electrically coupled to the spinneret 51 and to the collector 52 for generating an electric field therebetween. The soluble substrate 3 is placed on the collector 53 for collecting the electrospun polymeric fiber 21. In this embodiment, a plurality of the polymeric fibers 21 are formed on the soluble substrate 3 to constitute an electrospun web structure as depicted in FIG. 1. Since the electro spinning process is well known to a skilled artisan, a detailed description thereof is omitted herein for the sake of brevity.

Preferably, the polymer is selected from the group consisting of an acrylic-based polymer, a vinyl-based polymer, polyester, polyamide, and combinations thereof. The acrylic-based polymer may be polymethylmethacrylate (PMMA), polyacrylonitrile (PAN) or the like, the vinyl-based polymer may be polystyrene, polyvinyl acetate (PVAc) or the like, the polyester may be polycarbonate, poly ethylene terephthalate (PET) or the like, and the polyamide may be nylon. In this embodiment, the polymer used in the first solution is PMMA.

Preferably, the solvent is selected from the group consisting of alcohols, ketones, and combinations thereof. In this embodiment, the solvent is an admixture of methylethyl ketone (MEK) and methanol.

Preferably, the metal ion-containing precursor contains metal ions that are selected from the group consisting of gold ions, silver ions, copper ions, platinum ions and combinations thereof.

Preferably, the metal ion-containing precursor is selected from the group consisting of a metal salt, a metal halide, and an organometallic complex. The metal salt may be selected from the group consisting of silver trifluoroacetate ($CF_3COOAg$), silver acetate, silver nitrate, copper acetate, copper hydroxide, copper nitrate, copper sulfide, and sodium hexahydroxyplatinate. The metal halide may be selected from the group consisting of silver chloride, silver iodide, gold thrichlodride, chloroauric acid and copper chloride. The organometallic complex may be copper phthalocyanine. In this embodiment, the metal ion-containing precursor is $CF_3COOAg$.

It should be noted that, although increasing the thickness of the flexible transparent conductive film may lower the sheet resistance thereof, light transmittance would be thus adversely affected. In view of this understanding by skilled artisans, a thickness of around or less than 500 nm for the flexible transparent conductive film is preferred to exhibit relatively low sheet resistance while maintaining relatively high light transmittance. As such, in this embodiment, the electrospun polymeric fibers 21 have a diameter of around or less than 500 nm.

It is worth noting that, the amounts of the polymer and the metal ion-containing precursor used in the first solution may affect viscosity and conductivity of the first solution. The viscosity and the conductivity of the first solution are factors to adjust the diameter of the electrospun polymeric fiber 21 during the electrospinning process. Therefore, in order to obtain the electrospun polymeric fiber 21 having the diameter of around or less than 500 nm, PMMA is preferably present in an amount ranging from 10 wt % to 12 wt % based on the total weight of the first solution and a weight ratio of Ag in $CF_3COOAg$ to PMMA (abbreviated as Ag/PMMA) preferably ranges from 1/32 to 1/8.

Figure 3A:
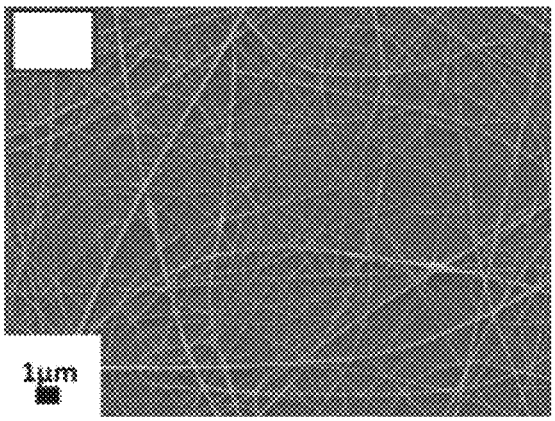
FIGS. 3(*a*) to 3(*c*) are scanning electron microscope (SEM) images of electrospun polymeric fibers, which were obtained from step (a) of the preferred embodiment under various polymer concentrations in a first solution (FIG. 3(*a*): 10 wt %, FIG. 3(*b*): 11 wt %, and FIG. 3(*c*): 12 wt %)
Figure 3B:
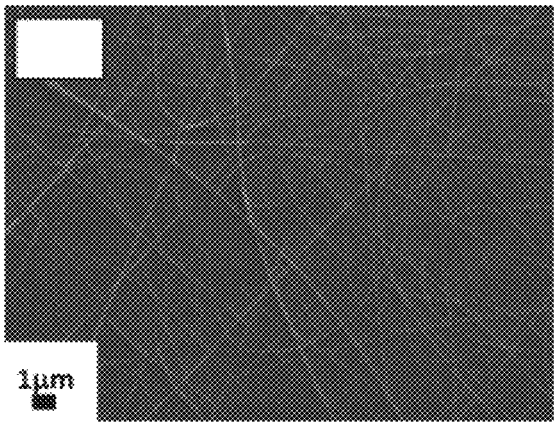
Figure 3C:
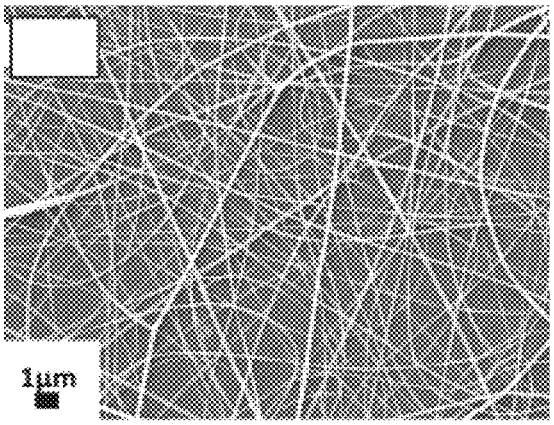

Referring to FIGS. 3(*a*) to 3(*c*), SEM images are presented to show the electrospun polymeric fibers 21 obtained from the electrospinning process in step (a) under various PMMA concentrations in the first solution (10 wt %, 11 wt %, and 12 wt %, corresponding respectively to FIGS. 3(*a*) to 3(*c*)). Other parameters of the electrospinning process remain the same (Ag/PMMA is 1/16, the electric field is 10 kV/cm, the flow rate of the first solution is 10 μl/minute, and the time period for conducting the electrospinning process is 30 seconds). An average diameter, a maximum diameter, standard deviation of the diameter, and a coefficient of variation for the electrospun polymeric fibers 21 shown in each of FIGS. 3(*a*) to 3(*c*) are listed in the following Table 1.

TABLE 1

| PMMA (wt %) | Average Diameter (nm) | Maximum Diameter (nm) | Standard Deviation (nm) | Coefficient of Variation (%) |
|---|---|---|---|---|
| 10 | 131.5 | 325 | ±57.2 | 43.5 |
| 11 | 166.0 | 325 | ±60.0 | 36.2 |
| 12 | 182.8 | 375 | ±58.7 | 32.1 |

Figure 4A:
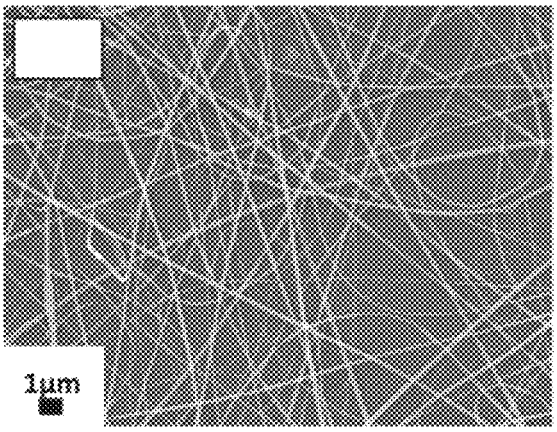
FIGS. 4(*a*) to 4(*c*) are SEM images of the electrospun polymeric fibers, which were obtained from step (a) of the preferred embodiment under various weight ratios of Ag in $CF_3COOAg$ to PMMA in the first solution (FIG. 4(*a*): 1/32, FIG. 4(*b*): 1/16, and FIG. 4(*c*): 1/8)
Figure 4B:
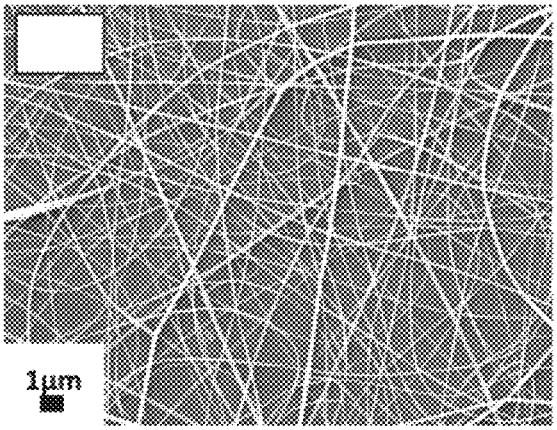
Figure 4C:
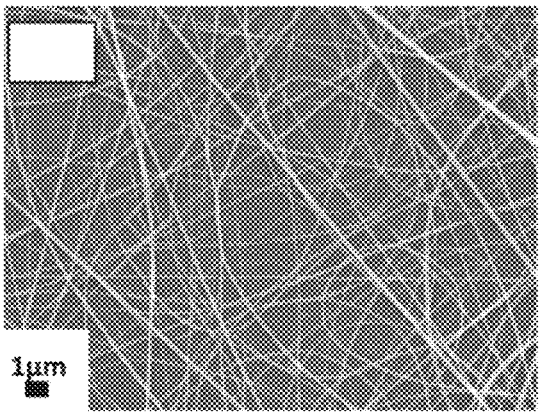

Referring to FIGS. 4(*a*) to 4(*c*), SEM images are presented to show the electrospun polymeric fibers 21 obtained from the electrospinning process in step (a) under various Ag/PMMA in the first solution (1/32, 1/16, and 1/8, corresponding respectively to FIGS. 4(*a*) to 4(*c*)). Other parameters of the electrospinning process remain the same (PMMA concentration is 12 wt %, the electric field is 10 kV/cm, the flow rate of the first solution is 10 μl/minute, and the time period for conducting the electrospinning process is 30 seconds). The average diameter, the maximum diameter, the standard deviation of the diameter, and the coefficient of variation for the electrospun polymeric fibers 21 shown in FIGS. 4(*a*) to 4(*c*) are listed in the following Table 2.

TABLE 2

| Ag/PMMA | Average Diameter (nm) | Maximum Diameter (nm) | Standard Deviation (nm) | Coefficient of Variation (%) |
|---|---|---|---|---|
| 1/32 | 211.7 | 450 | ±76.2 | 36.0 |
| 1/16 | 182.8 | 400 | ±58.7 | 32.1 |
| 18 | 181.2 | 500 | ±65.9 | 36.4 |

It should be noted that the applied electric field and the flow rate of the first solution are also factors affecting the diameter of the electrospun polymeric fiber 21. Preferably, the applied electric field is greater than 1 kV/cm and the flow rate of the first solution ranges from 5 μl/minute to 20 μl/minute in order to obtain the electrospun polymeric fiber 21 having the diameter of about or less than 500 nm. Regarding the time period for conducting the electrospinning process, it is a factor capable of adjusting the fiber surface density and the surface coverage rate of the electrospun web structure, and is thus capable of altering the light transmittance of the electrospun web structure. Preferably, the electrospinning process is conducted for a time period ranging from 30 seconds to 60 seconds.

Figure 5:
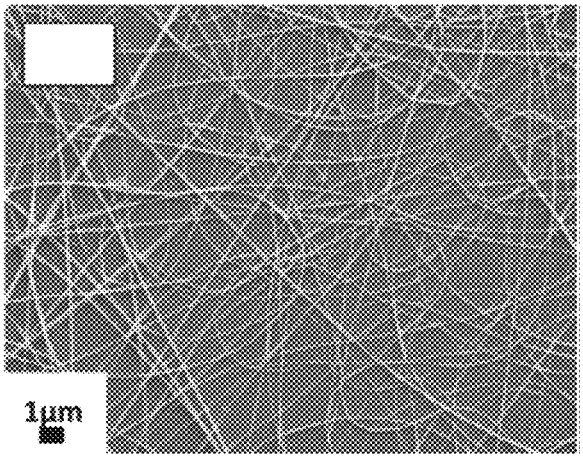
FIG. 5 is a SEM image of the electrospun polymeric fibers, which were obtained from step (a) of the preferred embodiment under an applied electric field of 1 kV/cm.

Referring to FIG. 5, a SEM image is presented to show the electrospun polymeric fiber 21 obtained from the electrospinning process in step (a) based on the following process parameters: PMMA concentration is 12 wt %, Ag/PMMA is 1/16, the electric field is 1 kV/cm, the flow rate of the first solution is 10 μl/cm, and the time period for conducting the electrospinning process is 30 seconds. The resultant electrospun polymeric fibers 21 have the maximum diameter of about 450 nm, the average diameter of 160.6 nm, standard deviation of the diameter is ±47.3 nm, and the coefficient of variation is 29.4%.

Figure 6A:
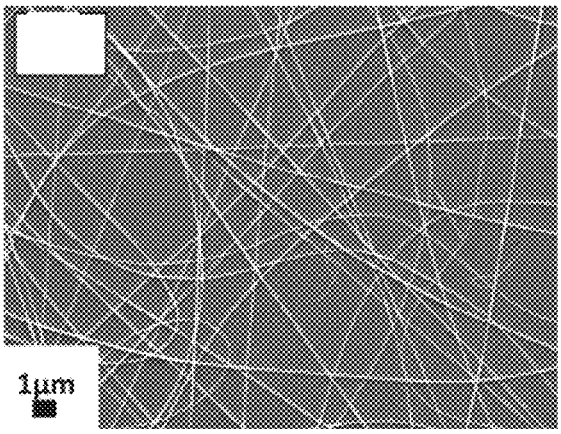
FIGS. 6(*a*) to 6(*c*) are SEM images of the electrospun polymeric fibers, which were obtained from step (a) of the preferred embodiment under various flow rates of the first solution (FIG. 6(*a*): 10 μl/cm, FIG. 6(*b*): 15 μl/cm and FIG. 6(*c*): 20 μl/cm)
Figure 6B:
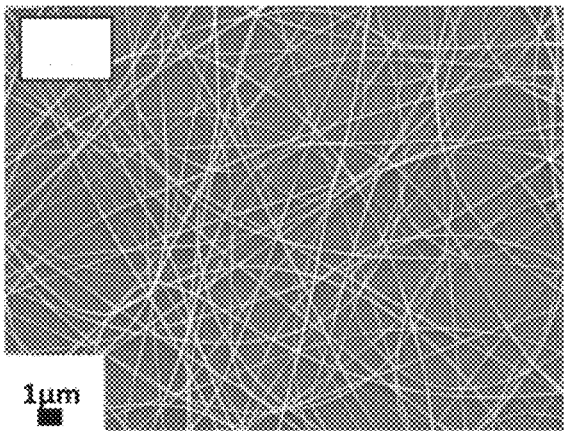
Figure 6C:
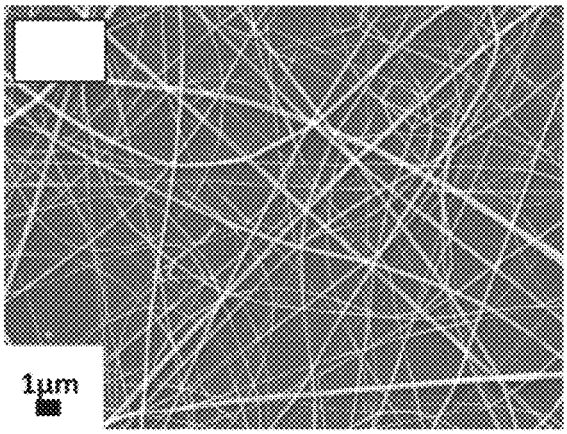

Referring to FIGS. 6(*a*) to 6(*c*), SEM images are presented to show the electrospun polymeric fibers 21 obtained from the electrospinning process based on various flow rates of the first solution (10 μl/minute, 15 μl/minute, and 20 μl/minute corresponding respectively to FIGS. 5(*a*) to 5(*c*)). Other parameters of the electrospinning process remain the same (PMMA concentration is 12 wt %, the electric field is 10 kV/cm, Ag/PMMA is 1/16, and the time period for conducting the electrospinning process is 30 seconds). The average diameter, the maximum diameter, the standard deviation of the diameter, and the coefficient of variation for the electrospun polymeric fibers 21 shown in each of FIGS. 6(*a*) to 6(*c*) are listed in the following Table 3.

TABLE 3

| Flow Rate (μl/minute) | Average Diameter (nm) | Maximum Diameter (nm) | Standard Deviation (nm) | Coefficient of Variation (%) |
|---|---|---|---|---|
| 10 | 160.7 | 200 | ±15.5 | 9.7 |
| 15 | 155.6 | 250 | ±22.8 | 14.7 |
| 20 | 171.3 | 500 | ±77.6 | 45.3 |

Figure 7A:
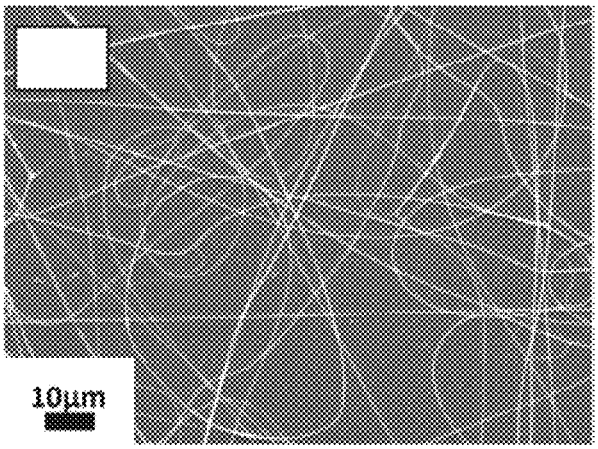
FIGS. 7(*a*) and 7(*b*) are SEM images of the electrospun polymeric fibers, which were obtained from step (a) of the preferred embodiment under various time periods for conducting an electrospinning process in step (a) (FIG. 7(*a*): 30 seconds and FIG. 7(*b*): 60 seconds)
Figure 7B:
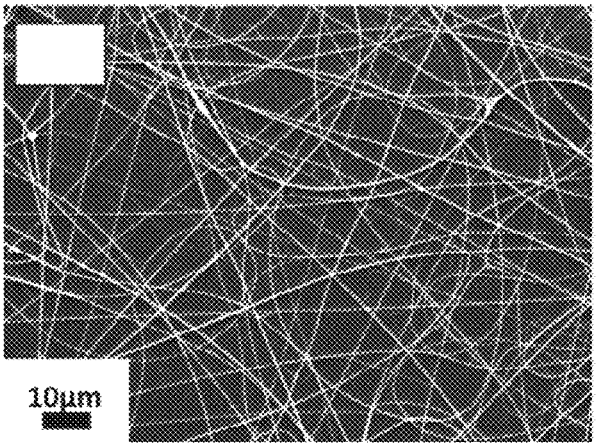
Figure 8:
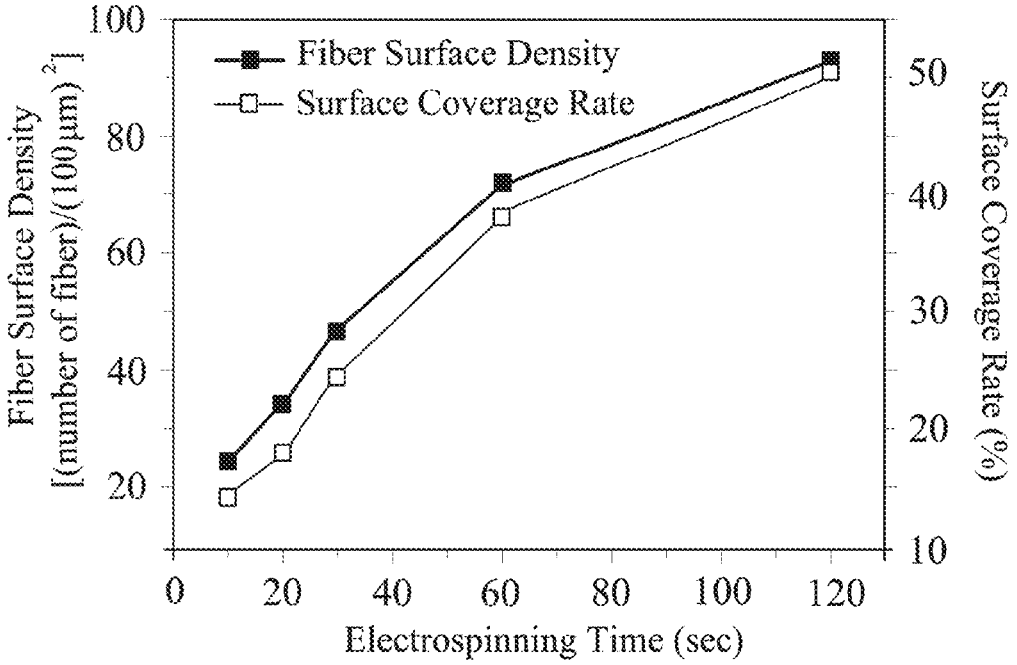
FIG. 8 is a graph illustrating fiber surface density as well as a surface coverage rate of an electrospun web structure obtained from step (a) of the preferred embodiment with respect to the time period for conducting the electrospinning process in step (a)
Figure 9:
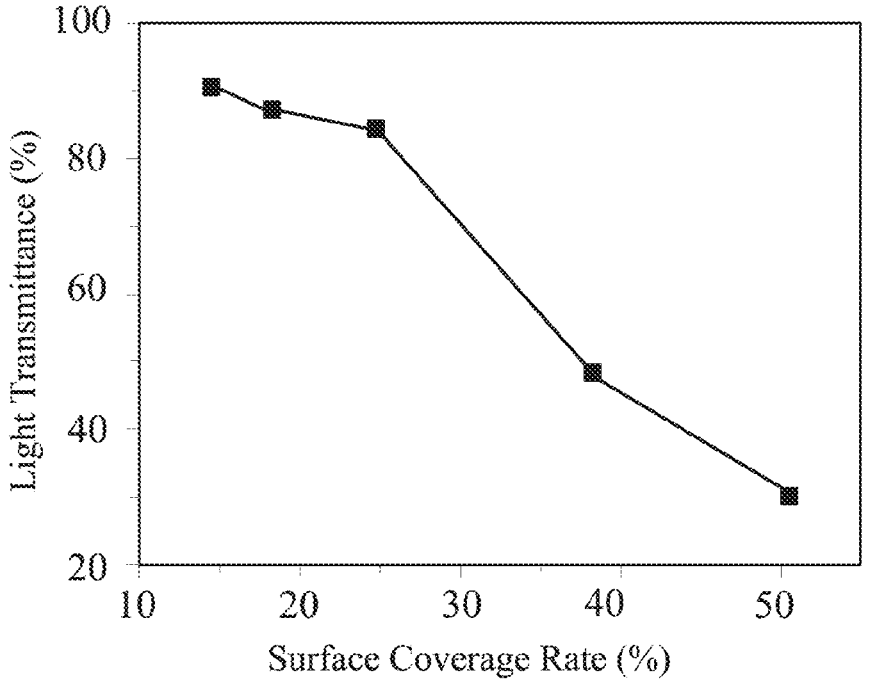
FIG. 9 is a graph illustrating light transmittance with respect to the surface coverage rate of the electrospun web structure obtained from Step (a) of the preferred embodiment.

Referring to FIGS. 7(*a*) and 7(*b*), SEM images are presented to illustrate that, in this embodiment, the fiber surface density of the electrospun web structure, which is constituted by the electrospun polymeric fibers 21, can be altered based on various time periods for conducting the electrospinning process (30 seconds and 60 seconds, corresponding respectively to FIGS. 7(*a*) and 7(*b*)). It is clearly shown that the electrospun web structure of FIG. 7(*a*) has a fiber surface density greater than that of FIG. 7(*b*). Further referring to FIG. 8, a graph is shown to illustrate the relationship between the fiber surface density of the electrospun web structure and the conducting time period of the electrospinning process, as well as the relationship between the surface coverage rate and the conducting time period of the electrospinning process (process parameters: PMMA concentration is 12 wt %, Ag/PMMA is 1/16, electric field is 10 kV/cm and the flow rate of the first solution is 10 μl/minute). It is clearly shown that the fiber surface density as well as the surface coverage rate of the electrospun web structure may increase when the time period for conducting the electrospinning process increases. Further referring to FIG. 9, which is a graph illustrating the relationship between the light transmittance and the surface coverage rate of the electrospun web structure, it is clearly shown that, when the surface coverage rate of the electrospun web structure increases, the light transmittance thereof decreases accordingly (process parameters: PMMA concentration is 12 wt %, Ag/PMMA is 1/16, the electric field is 10 kV/cm, and the flow rate of the first solution is 10 μl/minute, and the electrospun time are 10 s, 20 s, 30 s, 60 s, 120 s, respectively). However, it should be noted that, although the electrospun web structure may have relatively low surface coverage rate to attain relatively high light transmittance thereof, the electrospun web structure having a too low surface coverage rate may not be qualified to serve as a supporting frame to form the metal coating 4 thereon during the electroless plating process in step (c) due to insufficient mechanical strength of the electrospun web structure.

In accordance with the discussion as set forth above, in this embodiment, the electorspinning process in step (a) of the method is conducted under the process parameters that the PMMA concentration is 12 wt %, Ag/PMMA is 1/16, the electric field is 10 kV/cm, the flow rate of the first solution is 10 μl/minute, and the conducting time period is 30 seconds. The resultant electrospun polymeric fibers 21 under such process parameters have the average diameter of 182.8 nm with the standard deviation of 58.7 nm, and the coefficient of variation is 32.1%. The electrospun web structure constituted by the electrospun polymeric fibers 21 has a light transmittance of 92.3%.

Figure 10A:
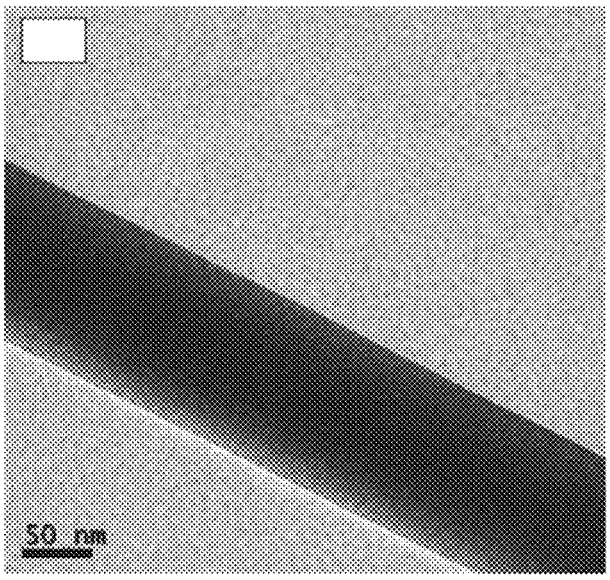
FIGS. 10(*a*) and 10(*b*) are transmission electron microscope (TEM) images of the electrospun polymeric fibers prior to and after conducting step (b) of the preferred embodiment, respectively.
Figure 10B:
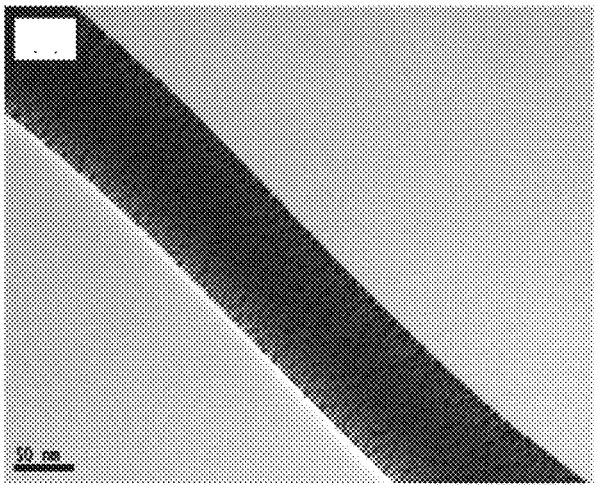
Figure 11A:
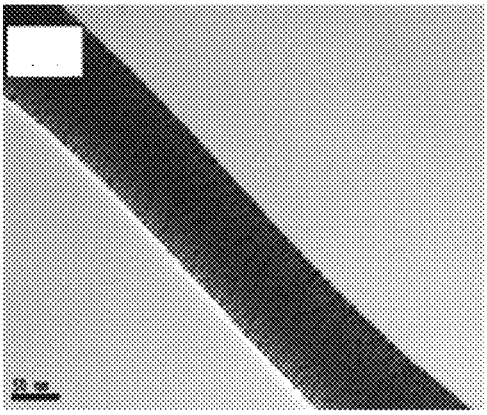
FIGS. 11(*a*) to 11(*f*) are TEM images of the electrospun polymeric fibers after conducting step (c) of the preferred embodiment for 0 minute, 1 minute, 3 minutes, 5 minutes, 10 minutes and 15 minutes, respectively.
Figure 11B:
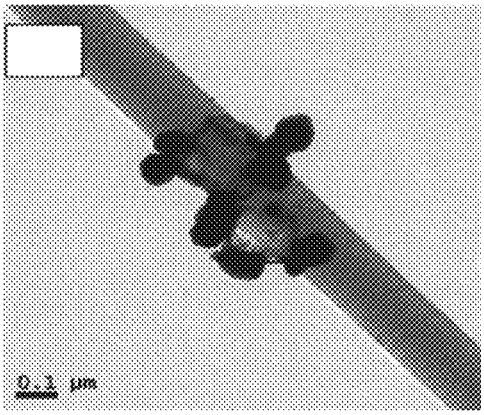
Figure 11C:
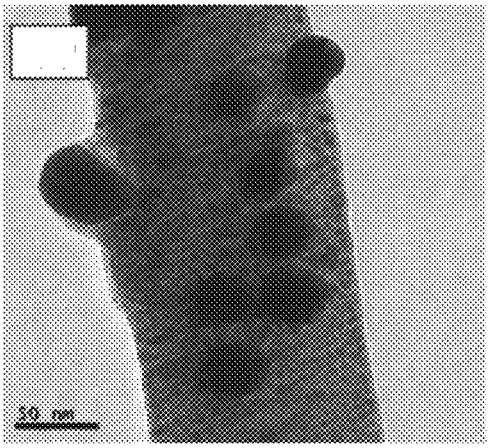
Figure 11D:
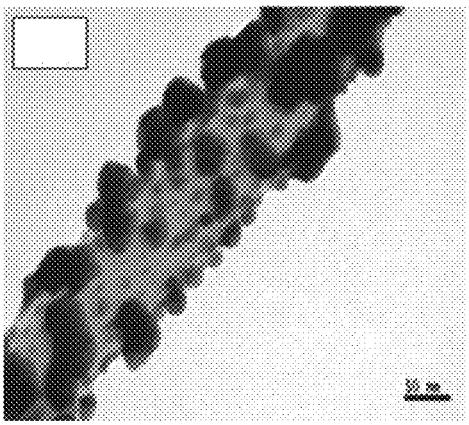
Figure 11E:
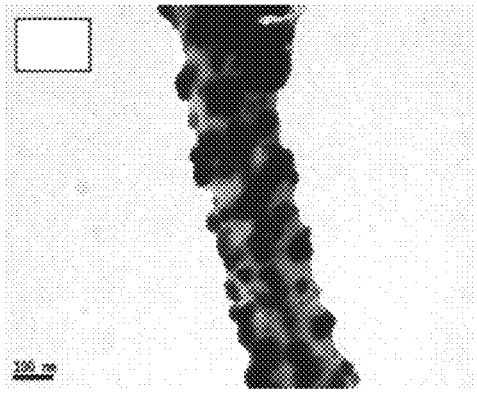
Figure 11F:
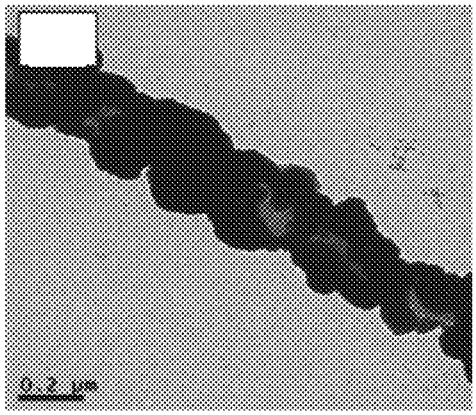

Preferably, step (b) is conducted by heat treating (i.e., annealing) the electrospun polymeric fiber 21 at a temperature of not greater than 100° C. for a time period of not less than 12 hours. In this embodiment, the nano-scale metal seeds 22 serve as nucleation sites to form the continuous metal coating 4 on the electrospun polymeric fibers 21 of the electrospun web structure during the electroless plating process in step (c). Referring to FIGS. 10(*a*) and 10(*b*), TEM images are presented to show the electrospun polymeric fibers 21 prior to and after step (b) of this embodiment. It is clearly shown that the nano-scale metal seeds 22 have not yet formed prior to step (b) as depicted in FIG. 10(*a*). On the other hand, after heat treating the electrospun polymeric fibers 21 at 100° C. for 12 hours (i.e., the step (b)), a relatively large amount of nano-scale silver seeds (i.e., the nano-scale metal seeds 22) are formed evenly on the elecrtrospun polymeric fibers 21 as shown in FIG. 10(*b*).

Preferably, the soluble substrate 3 is water-soluble, and the second solution as well as the electroless-plating bath is an aqueous solution. The soluble substrate 3 may be made of a material that is selected from the reducing agents, including glucose, glucamine, dextrose, glyoxal, hydride, hydrazine, aldehyde, polyhydric alcohol, aldose, or a ketose having an α-hydroxylketone group. Preferably, the aldose is glucose. In this embodiment, the soluble substrate 3 is made of glucose, and the second solution contains water, silver nitrate ($AgNO_3$), sodium hydroxide (NaOH), and ammonium hydroxide ($NH_4OH$).

It is worth noting that, in this embodiment, the second solution 41 is formed by sequentially adding an aqueous NaOH solution and $NH_4OH$ into an aqueous $AgNO_3$ solution, wherein $AgNO_3$ served as a metal ion source in the electroless plating process. The mechanism of the electroless plating process of this embodiment is described as follows. First, after mixing the NaOH solution with the $AgNO_3$ solution, NaOH reacts simultaneously with $AgNO_3$ to form silver oxide precipitates ($Ag_2O$). Thereafter, the latterly added ammonium hydroxide, serving as a complexant, reacts with $Ag_2O$ to form $[Ag(NH_3)_2]^+$ in the second solution 41. Lastly, the soluble substrate 3, which is made of glucose having an aldehyde group, is placed into the second solution to form the electroless-plating bath 42, such that the aldehyde group of glucose serves as a reducing agent to reduce $[Ag(NH_3)_2]^+$, resulting in formation of the continuous silver coating (i.e., the metal coating 4) on the electrospun polymeric fibers 21.

Skilled artisans will appreciate that process parameters, such as component concentrations, reaction temperature, reaction time or the like, may affect the reaction rate and the product amount of the electroless-plating process in step (c). Preferably, $AgNO_3$ is present in an amount not greater than 0.625 wt % based on the total weight of the electroless-plating bath 42, and the electroless plating in step (c) is conducted at a temperature of not greater than 40° C. for a time period ranging from 20 minutes to 40 minutes.

Referring to FIGS. 11(*a*) to 11(*f*), TEM images are presented to show a forming process of the metal coating 4 on the electrospun polymeric fiber 21, where FIGS. 11(*a*) to 11(*f*) correspond respectively to the resultant products after conducting step (c) for 0 minute, 1 minute, 3 minutes, 5 minutes, 10 minutes, and 15 minutes.

It is also worth noting that, when the electrospun polymeric fibers 21 are placed on an insoluble transparent substrate and are subjected to the electroless plating process together, the light-transmittance of the resultant transparent conductive film may be adversely affected since the metal coating 4 may not be merely formed on the electrospun polymeric fibers 21 but may be also formed unconditionally on the insoluble transparent substrate. In addition, if the soluble substrate 3 is made of a material (such as sodium chloride) which is not a component of the electroless-plating bath 41, additional steps, such as placing the electrospun polymeric fiber 21 and the soluble substrate 3 into a solvent to dissolve the soluble substrate 3 and extracting the polymeric fiber 21 from the solvent, are thus needed. Moreover, such extraction of the electrospun polymeric fiber 21 may damage the electrospun web structure formed by the electrospun polymeric fiber 21, thereby adversely affecting the product yield of the transparent conductive film.

It should be noted that the soluble substrate 3 is for supporting the electrospun web structure before conducting step (c). As such, when the soluble substrate 3 is too thin (i.e., insufficient amount of glucose), the soluble substrate 3 may not have sufficient supporting strength for the electrospun web structure. On the other hand, when the soluble substrate 3 provides too much glucose during the electroless plating process, excess amount of silver particles may be over-deposited that adversely affects the light transmittance of the flexible transparent conductive film. Preferably, glucose is present in an amount ranging from 7 wt % to 13 wt % based on the total weight of the electroless-plating bath.

EXAMPLES

A solvent was prepared by mixing MEK and methanol at a volume ratio of 2:1. 0.33 gram of PMMA was then added into 3 ml of the solvent, followed by stirring for 10 hours to dissolve PMMA completely in the solvent. 0.04 gram of $CF_3COOAg$ was then added into the solvent to form a first solution, wherein PMMA is present in an amount of 12 wt % based on the total weight of the first solution, and a weight ratio of Ag in $CF_3COOAg$ to PMMA in the first solution is 1/16. In the meantime, 0.3 gram of glucose powder was pressed by an oil hydraulic pressing machine under an applied pressure, which ranges from 25 kgf/cm$^2$ to 35 kgf/cm$^2$, to form a circular soluble substrate having a diameter of 1 cm. The first solution was subjected to an electrospinning process for 30 seconds under an electric field intensity of 1 kV/cm and a flow rate of 10 μl/cm, so as to form a plurality of electrospun polymeric fibers that constitute a web structure on the soluble substrate. The web structure of the electrospun polymeric fibers was then heated at 100° C. for 12 hours, so as to form a plurality of silver nano-seeds on the web structure. Thereafter, 5 ml of silver nitrate aqueous solution (>5 wt %) was mixed with 60 μl of sodium hydroxide aqueous solution (>2 wt %) to form silver oxide precipitates, followed by adding ammonium hydroxide aqueous solution to allow silver oxide to react with ammonium hydroxide so as to form a second solution. The web structure together with the soluble substrate was then placed into the second solution and the soluble substrate was then dissolved in the second solution so as to form an electroless-plating bath. The web structure was subjected to the electroless plating process in the electroless-plating bath for 5 minutes, so that a silver coating was formed on the web structure thereby obtaining a flexible transparent conductive film of Example 1. Based on the total weight of the electroless-plating bath, silver nitrate was present in an amount of 0.625 wt %, sodium hydroxide was present in an amount of 2 wt %, ammonium hydroxide was present in an amount of 5 wt %, and $C_6H_{12}O_6$ was present in an amount of 10 wt %.

Similarly, the flexible transparent conductive film of Examples 2 to 12 were obtained by a method similar to that of Example 1, while the electroless plating processes for Examples 2 to 12 were conducted for 10 minutes, 15 minutes, 20 minutes, 25 minutes, 30 minutes, 35 minutes, 40 minutes, 45 minutes, 50 minutes, 55 minutes, and 60 minutes, respectively.

Comparative Example

1 μm-thickness ITO film was utilized as a comparative example and was placed on a PET substrate having dimensions of 5 μm in thickness, 50 mm in length and 15 mm in width.

<Measurement>

[Sheet Resistance/Light-Transmittance Measurements]

Figure 12:
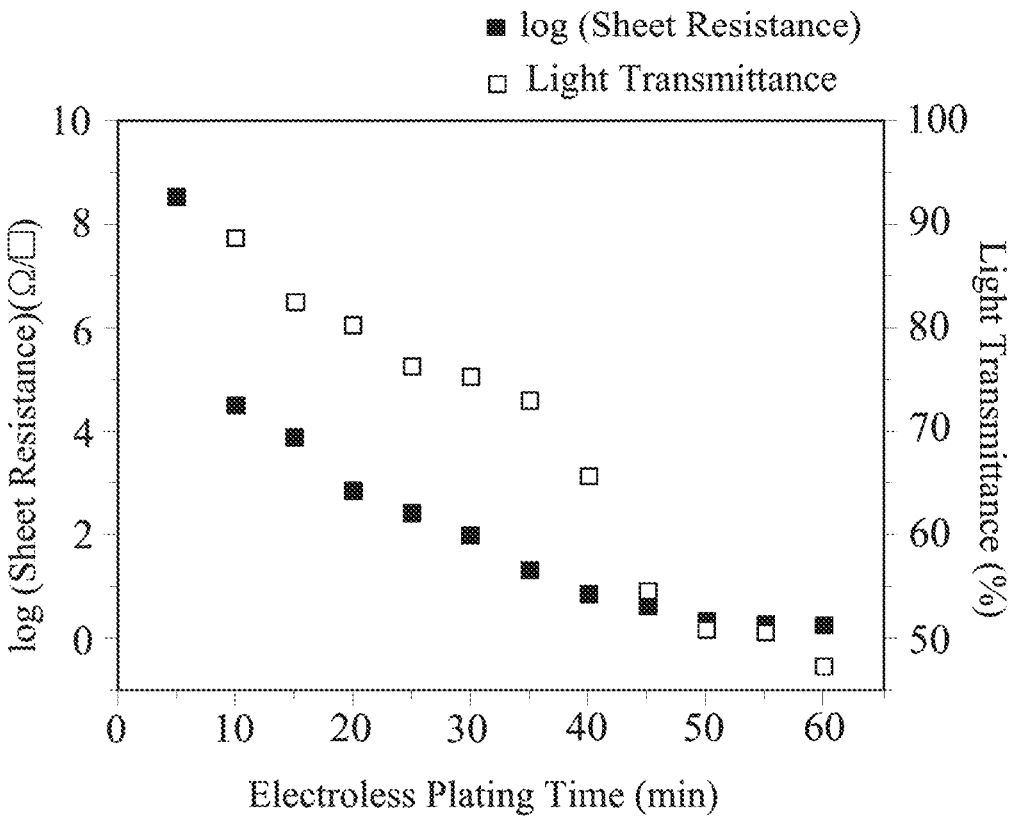
FIG. 12 is a graph illustrating a sheet resistance, as well as the light transmittance, of the flexible transparent conductive film of Examples 1 to 12 with respect to a time period for conducting an electroless plating process in step (c) of the preferred embodiment.

The flexible transparent conductive film of each of the Examples 1 to 12 was placed on a quartz substrate after the electroless plating process and was subjected to sheet resistance and light transmittance measurements. The results are shown in FIG. 12, wherein light transmittance of Examples 6 to 8 are 75%, 73% and 66%, respectively, and sheet resistance of Examples 6 to 8 are 100 Ω/□, 16Ω/□, and 10Ω/□, respectively.

[Anti-Fatigue Analysis]

Figure 13A:
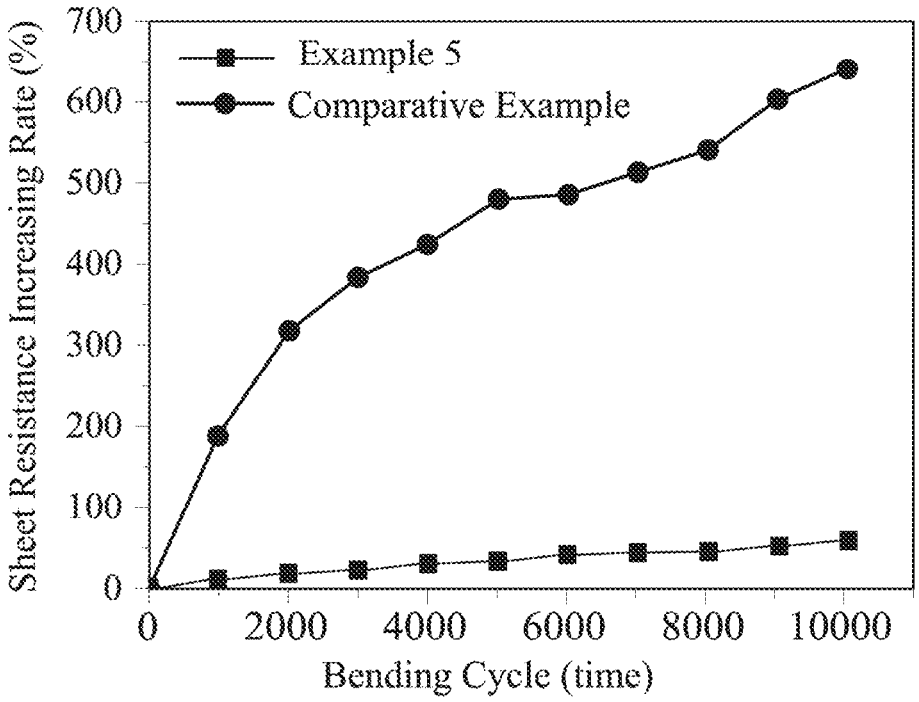
FIG. 13(*a*) is a graph illustrating a sheet resistance-increasing ratio with respect to the number of bending cycles of the flexible transparent conductive films of Example 5 as well as a comparative example.
Figure 13B:
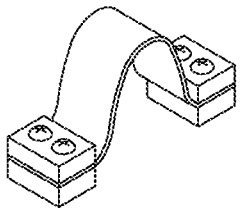

Referring to FIGS. 13(*a*) and 13(*b*), the flexible transparent conductive film of Example 5, like the comparative example, was placed onto a PET substrate having a length of 50 mm and a width of 15 mm, and was subjected to anti-fatigue analysis. In detail, as shown in FIG. 13(*b*), two distal ends of the PET substrate, as well as the flexible transparent conductive film of Example 5, were clamped by two separate clamping holders which are spaced apart from each other by a distance of 45 mm. Then, a motor drove the clamping holders to move toward or away from each other, so as to bend the PET substrate and the flexible transparent conductive film or to recover the same from bending. During the bending stage, the motor drove each of the clamping holders to move 10 mm toward the other, such that midpoint of the flexible transparent conductive film of Example 5 was bent to have a displacement of 17 mm from its original position. Then, the clamping holders were driven to move back to their original position to recover the flexible transparent conductive film of Example 5 from bending to constitute a full bending cycle. Sheet resistance of Example 5, as well as the comparative example, was measured after conducting various bending cycles and the results are shown in FIG. 13(*a*). As depicted in FIG. 13(*a*), the flexible transparent conductive film of Example 5 had an initial sheet resistance ($R_0$) of 15.2Ω/□, and a sheet resistance-increasing ratio $[((R-R_0)/R)\times100\%]$ of 65% after 10000 bending cycles (resultant sheet resistance (R) is 24.4Ω/□). On the other hand, the comparative example had the initial sheet resistance ($R_0$) of 5Ω/□ and the sheet resistance-increasing ratio of 200% after 1000 bending cycles and of 640% after 10000 bending cycles.

[Thermal Reliability Analysis]

A thermal reliability standard of the flexible transparent conductive film, which is setup and adopted by OIKE & Co., Ltd., is provided in the following Table 4.

| Testing Condition | 90° C. × 250 hours | 150° C. × 90 mins |
|---|---|---|
| Sheet Resistance ratio($R/R_0$)* | ≤1.3 | ≤1.3 |

*$R_0$ represents initial sheet resistance; and R represents sheet resistance after thermal reliability testing.

Figure 14:
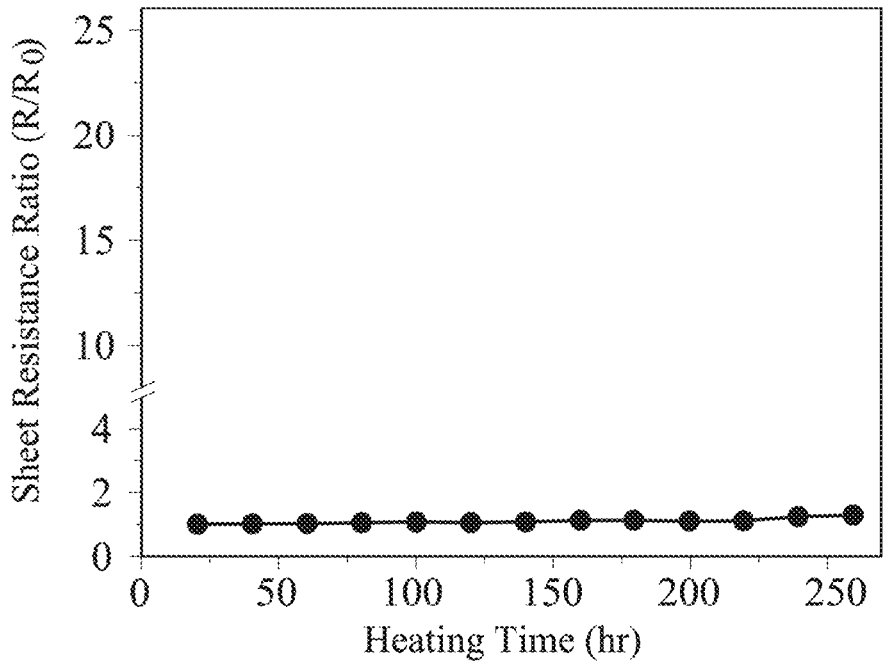
FIG. 14 is a graph illustrating the sheet resistance ratio of the flexible transparent conductive film of Example 5 with respect to a heating period at 90° C. during a thermal reliability analysis.
Figure 15:
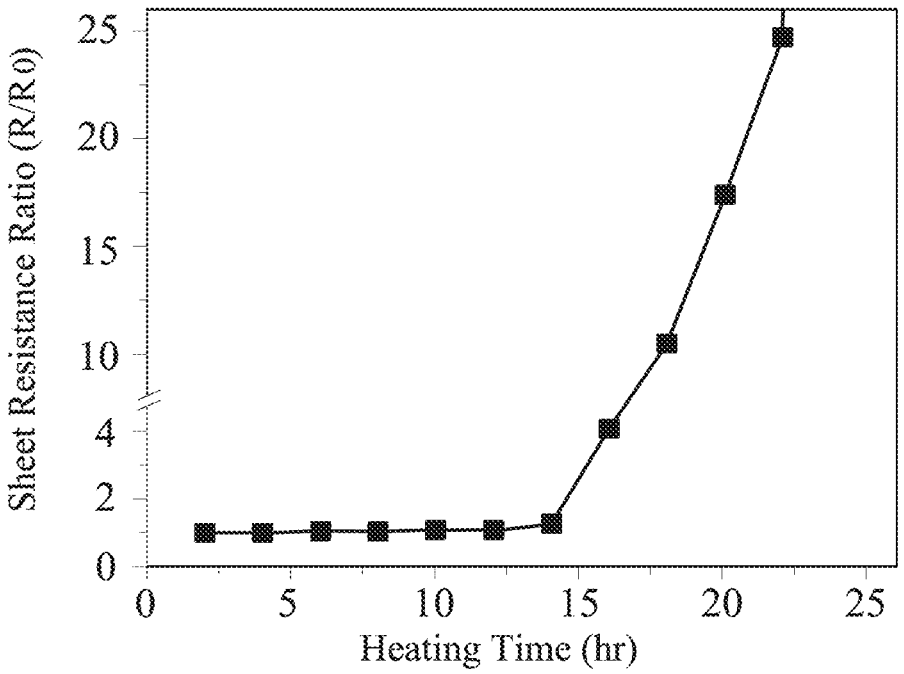
FIG. 15 is a graph illustrating the sheet resistance ratio of the flexible transparent conductive film of Example 5 with respect to a heating period at 150° C. during a thermal reliability analysis.

The flexible transparent conductive film of Example 5 was subjected to the thermal reliability tests based on the two testing conditions of Table 4, and the results are respectively shown in FIGS. 14 and 15. As shown in FIG. 14, the flexible transparent conductive film of Example 5 had a sheet resistance ratio of 1.07 after heating at 90° C. for 250 hours, which is smaller than the standard value of 1.3. In addition, as shown in FIG. 15, the flexible transparent conductive film of Example 5 even had a sheet resistance ratio of less than 1.3 after heating at 150° C. for 18 consecutive hours that is much longer than the standard value of 90 minutes.

Figure 16A:
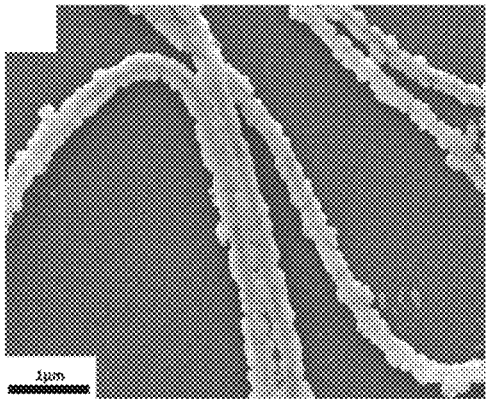
FIGS. 16(*a*) to 16(*c*) are SEM images of the transparent conductive film of Example 5 with respect to the heating period at 150° C. during the thermal reliability analysis (FIG. 16(*a*): 10 hours, FIG. 16(*b*): 18 hours and FIG. 16(*c*): 26 hours).
Figure 16B:
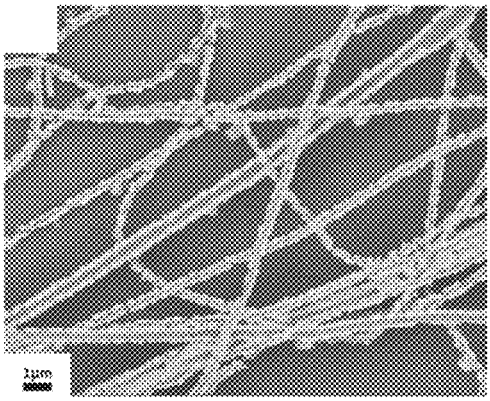
Figure 16C:
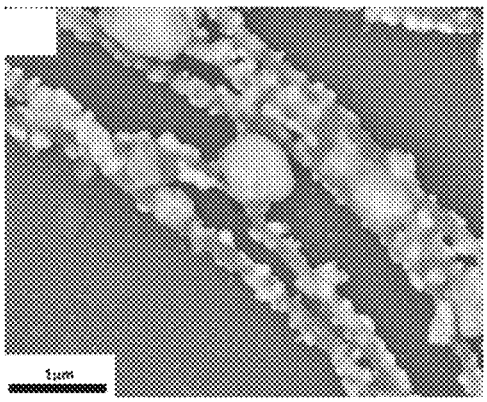

Referring to FIGS. 16(*a*) to 16(*c*), SEM images are presented to illustrate that flexible transparent conductive films of Example 5 were heated at 150° C. for various time periods (10 hours, 18 hours and 26 hours, respectively). As shown in FIG. 16(*a*), the silver coating still covers the surface of the electrospun polymeric fibers (i.e., PMMA), and thus the sheet resistance ratio of Example 5 remains at 1.07. As shown in FIG. 16(*b*), after heating at 150° C. for 18 hours, the sheet resistance ratio of Example 5 increased to 10.4 due to diffusion of silver atoms and the resultant formation of silver clusters, which decreases the continuity, as well as the conductivity of the silver coating. Since the heating temperature is above the glass transition temperature of PMMA, the transition of the electrospun polymeric fibers into the rubbery state also enhances the diffusion of the silver atoms. As shown in FIG. 16(*c*), after heating at 150° C. for consecutive 26 hours, the silver coating of Example 5 completely lost its continuity and resulted in dramatic increase in the sheet resistance ratio.

The method of the preferred embodiment according to the present invention adopts the electrospinning process that is suitable for mass production at relatively low cost. In addition, heat treatment in step (b) of the method of the preferred embodiment only needs to be conducted at a relatively low temperature (not greater than 100° C.), and the electroless plating process in step (c) does not require expensive deposition equipments. Moreover, the flexible transparent conductive film made by the method of the preferred embodiment may have a sheet resistance of 100Ω/□ while keeping its light transmittance at 75%. Furthermore, the flexible transparent conductive film may have a sheet resistance-increasing rate of about 65% after 10000 bending cycles, and a sheet resistance ratio of less than 1.3 under heating at 150° C. for 15 consecutive hours or under heating at 90° C. for consecutive 250 hours. It is clearly shown from the foregoing that the flexible transparent conductive film made by the method of the preferred embodiment exhibits relatively low sheet resistance while maintaining relatively high light transmittance, as well as relatively high thermal reliability and strong fatigue resistance.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method for forming a flexible transparent conductive film, comprising the following steps of:

(a) electrospinning a first solution, which contains a polymer, a solvent and a metal ion-containing precursor, to form an electrospun polymeric fiber onto a soluble substrate, the substrate being made of glucose;

(b) providing energy to reduce the metal ion-containing precursor of the electrospun polymeric fiber, so as to form metal seeds on the electrospun polymeric fiber; and (c) placing the electrospun polymeric fiber together with the soluble substrate into a second solution, such that the soluble substrate dissolves in the second solution to form an electroless-plating bath and such that the electrospun polymeric fiber is subjected to electroless plating to form a metal coating from the metal seeds.

2. The method of claim 1, wherein, in step (a), the polymeric fiber is electrospun into a web structure.

3. The method of claim 1, wherein:

in step (c), the second solution and the electroless-plating bath are aqueous solutions.

4. The method of claim 1, wherein the second solution contains silver nitrate, sodium hydroxide, and ammonium hydroxide.

5. The method of claim 4, wherein, based on the total weight of the electroless-plating bath, silver nitrate is present in an amount not greater than 0.625 wt %, and glucose is present in an amount ranging from 7 wt % to 13 wt %.

6. The method of claim 5, wherein, in step (c), electroless plating is conducted at a temperature of not greater than 40° C. for a time period ranging from 20 minutes to 40 minutes.

7. The method of claim 1, wherein, in step (a), the polymer is selected from the group consisting of an acrylic-based polymer, a vinyl-based polymer, polyester, polyamide, and combinations thereof.

8. The method of claim 7, wherein the acrylic-based polymer is one of polymethylmethacrylate (PMMA) and polyacrylonitrile (PAN), the vinyl-based polymer is one of polystyrene (PS) and polyvinyl acetate (PVAc), the polyester is one of polycarbonate and polyethylene terephthalate, and the polyamide is nylon.

9. The method of claim 1, wherein the metal ion-containing precursor contains metal ions that are selected from the group consisting of gold ions, silver ions, copper ions, platinum ions and combinations thereof.

10. The method of claim 1, wherein the metal ion-containing precursor is selected from the group consisting of a metal salt, a metal halide, and an organometallic complex.

11. The method of claim 10, wherein the metal salt is selected from the group consisting of silver trifluoroacetate, silver acetate, silver nitrate, copper acetate, copper hydroxide, copper nitrate, copper sulfide, and sodium hexahydroxyplatinate.

12. The method of claim 10, wherein the metal halide is selected from the group consisting of silver chloride, silver iodide, gold trichloride, chloroauric acid, and copper chloride.

13. The method of claim 10, wherein the organometallic compound is copper phthalocyanine.

14. The method of claim 11, wherein the polymer is polymethylmethacrylate, and the metal ion-containing precursor is silver trifluoroacetate.

15. The method of claim 14, wherein, based on the total weight of the first solution, polymethylmethacrylate (PMMA) is present in an amount ranging from 10 wt % to 12 wt %, and a weight ratio of silver in silver trifluoroacetate to PMMA ranges from 1/32 to 1/8.

16. The method of claim 1, wherein step (a) is conducted for a time period ranging from 30 seconds to 60 seconds under an electric field that is greater than 1 kV/cm and a flow rate of the first solution ranging from 5 μl/minute to 20 μl/minute.

17. The method of claim 1, wherein step (b) is conducted by heat treating the electrospun polymeric fiber at a temperature of not greater than 100° C. for a time period of not less than 12 hours.

18. The method of claim 1, wherein, in step (b), the metal seeds are substantially in a nanometer scale.

* * * * *